United States Patent [19]

Hicks et al.

[11] 4,370,064

[45] Jan. 25, 1983

[54] COUNTING DEVICE WITH BALL ACTUATED ALIGNED ROTATABLE INDICATING ELEMENTS

[75] Inventors: Alan A. Hicks, Chicago; Howard J. Morrison, Deerfield; John R. Wildman, North Riverside; Terry E. Webb, West Chicago, all of Ill.

[73] Assignee: Marvin Glass & Associates, Chicago, Ill.

[21] Appl. No.: 193,934

[22] Filed: Oct. 6, 1980

[51] Int. Cl.[3] ..... G04F 1/04

[52] U.S. Cl. ..... 368/93; 368/223; 235/127

[58] Field of Search ..... 368/93, 94, 88, 95, 368/223, 77, 139; 116/200, 215; 235/127, 106, 91 K, 1 B

[56] References Cited

U.S. PATENT DOCUMENTS

| | | | |
|---|---|---|---|
| 1,792,166 | 2/1931 | Horstmann | 235/127 |
| 3,006,082 | 10/1961 | Libbey | 235/127 |
| 4,077,198 | 3/1978 | Mayenschein | 368/223 |

*Primary Examiner*—Bernard Roskoski

*Attorney, Agent, or Firm*—McDermott, Will & Emery

[57] ABSTRACT

A counting device with ball actuated, aligned, rotatable indicating elements is disclosed that is particularly useful as a clock. The device includes a plurality of indicating elements rotatable around parallel axes, arranged side by side in three columns. Each indicating element includes a display portion and a ball actuated flange, mounted on a common axle with the flanges of adjacent elements in each column forming a ball conveying track. The elements are successively rotated to the upward display position by a ball whose continued presence atop an element's flange causes an appropriate rotation of that element. The balls are continuously recycled by a synchronous motor elevator which collects the balls at their lowest position and returns them to their highest position in communication with the ball conveying tracks. After all of the indicating elements in a column have been raised to their display position, the ball resets the first rotated element causing it to reset the adjacent elements. In this way the elements are returned to their downward position by a domino effect.

30 Claims, 7 Drawing Figures

COUNTING DEVICE WITH BALL ACTUATED ALIGNED ROTATABLE INDICATING ELEMENTS

BACKGROUND OF THE INVENTION

1. Field of the Invention

This invention relates generally to counting devices and particularly to time-keeping devices.

2. Brief Description of the Prior Art

In the past, clocks and timing devices have taken a variety of forms with the result that these devices now have functional as well as entertainment value. For example, U.S. Pat. No. 4,077,198 issued to Mayenschein shows a clock that indicates time by the number of balls in certain significant positions.

SUMMARY OF THE INVENTION

It is an object of the present invention to provide a clock which displays time in a novel manner.

It is also an object of the present invention to provide a clock whose display is actuated by rolling balls which cause successive time indicating elements to be rotated from a non-display to a display position and back to their non-display position in domino falling fashion.

These and other objects of the present invention are achieved by a clock or counting device including a ball and a housing having an inclined track including high and low ends for the ball. A plurality of indicating elements are aligned along the track, arranged side by side in a line and mounted for rotation against the next adjacent element in the line. An actuating means is operatively connected to the indicating elements for rotating the elements when the actuating means is contacted by the ball as it rolls in one of the tracks. Means are also included for raising the ball from the low end of the tracks to the high end of the tracks.

DESCRIPTION OF THE PREFERRED EMBODIMENT

Figure 1:
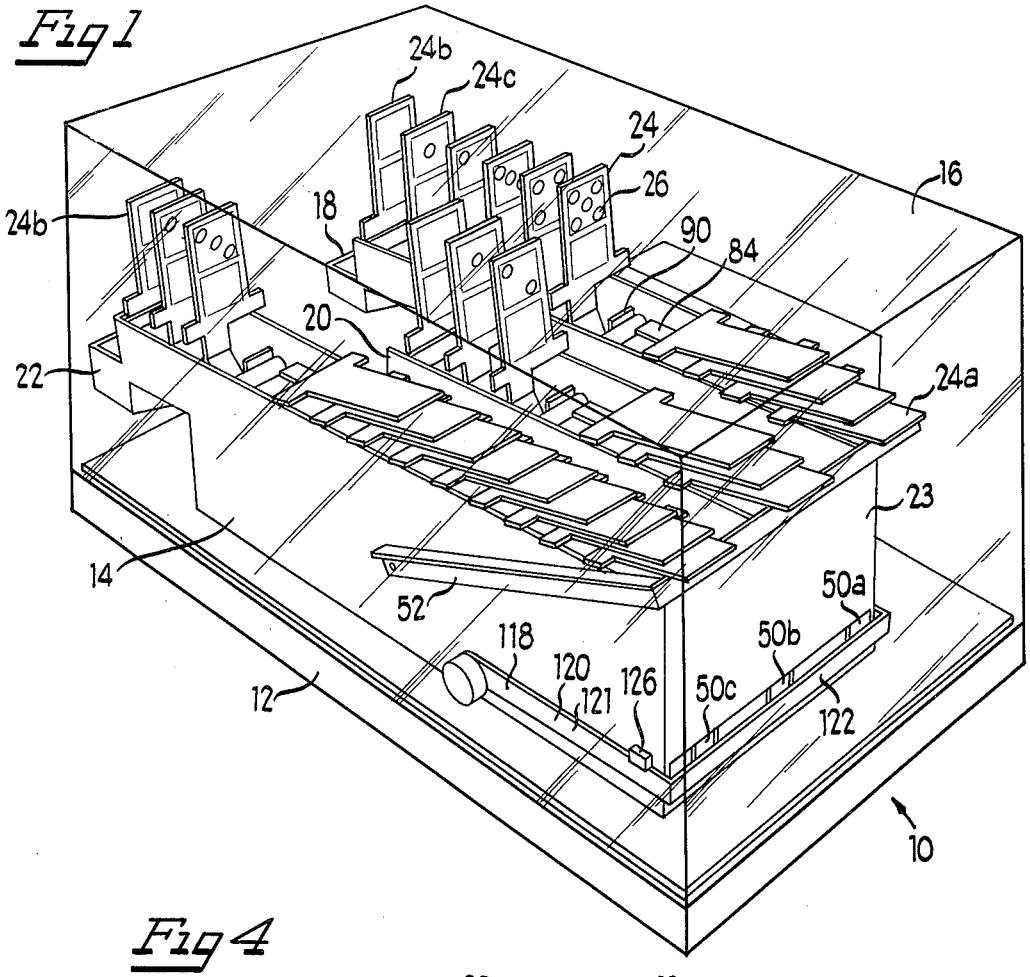
FIG. 1 is a perspective view of one embodiment of the clock of the present invention.

Referring to the drawing wherein like reference characters are used for like parts throughout the several views, the clock or counting device 10 is illustrated in FIG. 1. The device 10 includes a base 12 and an E-shaped housing 14 positioned atop the base 12 and enclosed by a removable, transparent, rectangular enclosure or dust cover 16. The housing 14 includes three spaced, interconnected, elongated rectangular units 18, 20 and 22 each extending a different distance out from a common side 23 of housing 14 with a plurality of thin, lightweight, indicating elements 24 arranged along its length. Elements 24 bear a number of domino dots 26 on one surface that increases from one adjacent element to the next.

Figure 2:
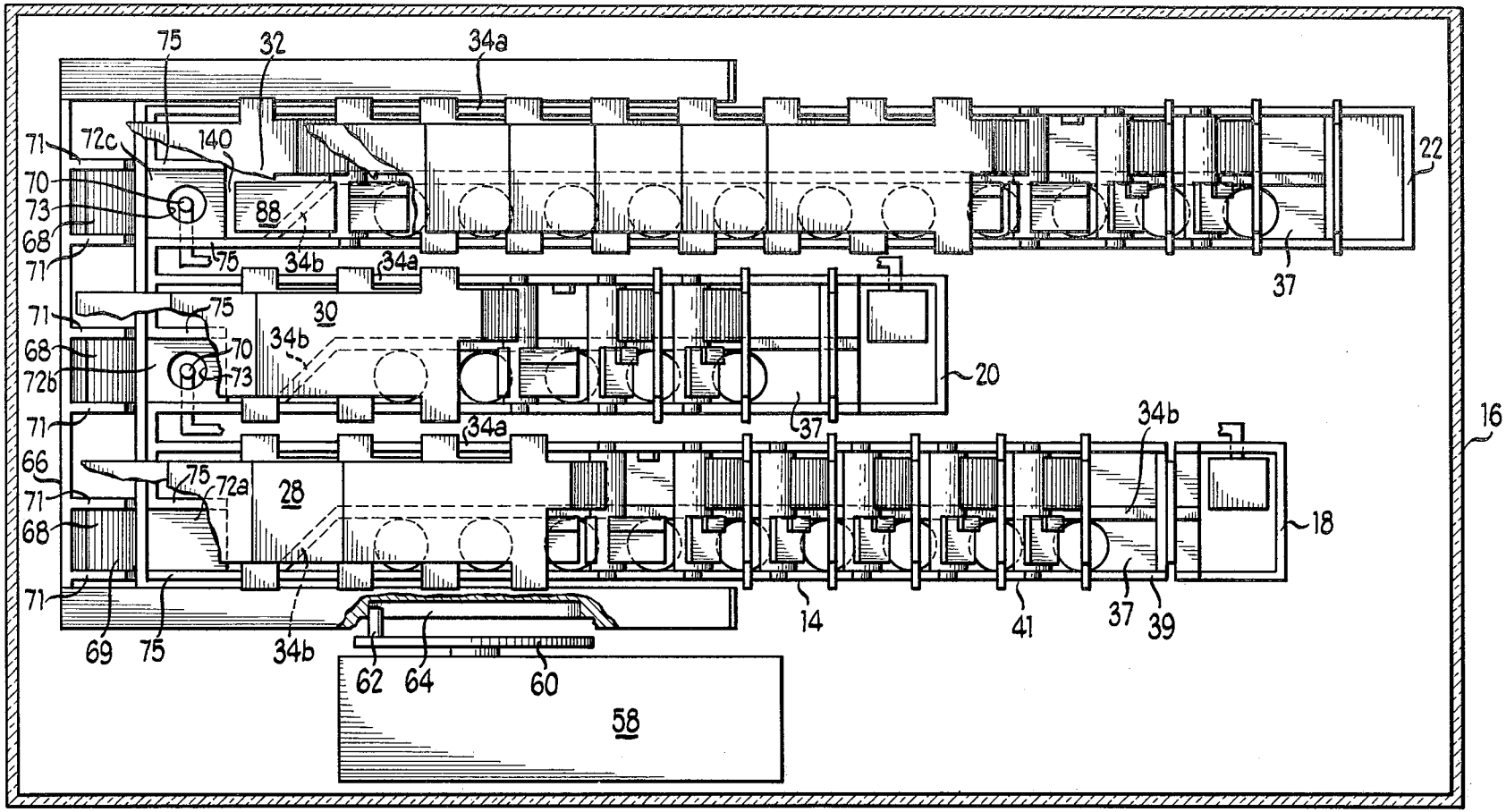
FIG. 2 is an enlarged, partially cut away, plan view of the embodiment of the present invention shown in FIG. 1.

Referring to FIG. 2, three ball conveying tracks 28, 30 and 32 are defined by spaced, generally parallel, upstanding walls 34 on the upper surface of the housing 14. The walls 34*a* are formed from an exterior side wall 35 of each unit 18, 20 or 22 while the walls 34*b* are internal of the housing and include an angled cross portion 43. Each track 28, 30 or 32 inclines downwardly from left to right in FIG. 2 so that a ball positioned on the left side of any track shown in FIG. 2 rolls to the right. The track 28 of unit 18 communicates with unit 20 by an elongated pivoting member 36, also shown in FIG. 3, pivotally mounted at 38 while track 30 of unit 20 communicates with unit 22 by a similar, alongated pivoting member 40 mounted at 42 on housing 20. Each pivoting member 36 or 40 includes an upstanding pin 70 on one end and a gently inclined platform 74 on the other end. The pin 70 acts in one unit 20 or 22 while the platform 74 acts in a different unit 18 or 20. An inclined, apertured surface 37 (FIG. 5) is located alongside each track 28, 30 or 32, defined by the upstanding wall 34*b* and a portion 39 of the other exterior side wall 41 of each unit 18, 20 or 22.

Figure 4:
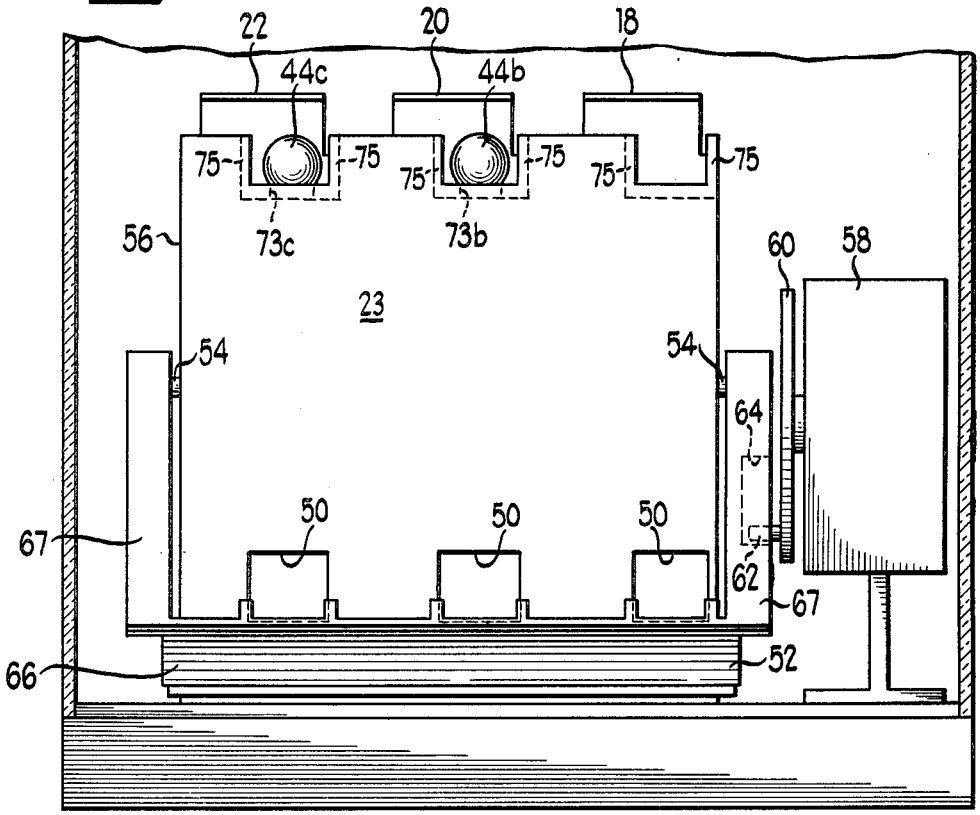
FIG. 4 is an enlarged, partial, front elevational view of the embodiment shown in FIG. 1.

A U-shaped ball lifting mechanism or elevator 52 is pivotally mounted by pivot pins 54 on either side 56 of housing 14 to rotate along common side 23 between a downward position below apertures 50, as shown in FIG. 4 and an upward position shown in FIG. 1 adjacent the top edge 51 of side 23. The elevator 52 includes a cross-member 66 connecting two lateral members 67. The rotation of the U-shaped elevator 52 is due to a synchronous motor 58 that continually rotates a drive disc 60 at one revolution per minute, The disc 60 includes an outwardly extending pin 62 located near its periphery. The pin 62 rides in a slot 64 in a lateral member 67 of elevator 52 so that the elevator 52 is continuously oscillated between its upward and downward positions. As shown in FIG. 2, cross-member 66 has three distinct V-shaped depressions 68 on its upper surface each aligned to receive a ball 44 dispensed from each aperture 50. Each depression 68 includes a pair of spaced parallel walls 71 and a lower surface 69 having a canted V-shaped configuration when the elevator is in its lower position, rotated to an L-shaped "pouring" configuration when the elevator 52 moves to its upward position.

Figure 7:
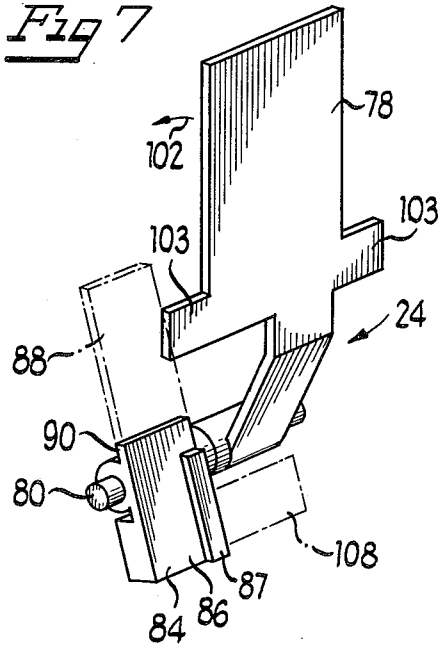
FIG. 7 is an enlarged, perspective view of an indicating element shown in FIG. 1.
Figure 6:
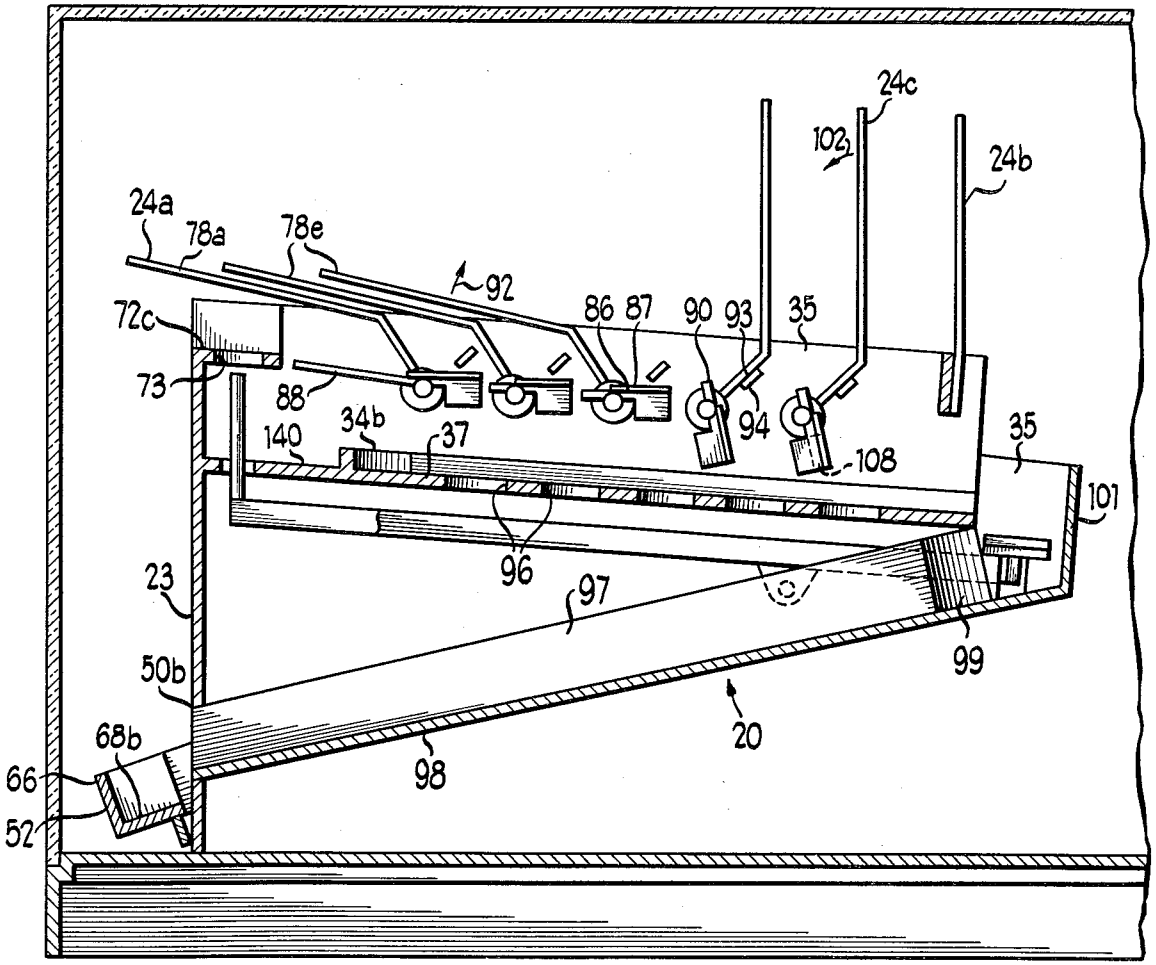
FIG. 6 is an enlarged, partial, cross-sectional view taken generally along the line 6—6 in FIG. 1.

Referring to FIGS. 6 and 7 a path for a ball 44 is formed above the apertured surface 37 adjacent track 30 in unit 20 by a plurality of aligned side by side indicating elements 24. Each indicating element 24 includes a thin, L-shaped, rectangular display portion 78 fixed to an axle 80 retained between adjacent exterior side walls 35 and 41. Near the base of portion 78 a pair of outwardly extending tabs 103 support the portion 78 atop walls 35 and 41 when the element 24 is in its downward position. Also fixed to axle 80 extending outwardly at an angle of approximately 135° with respect to portion 78 is a flange 84. Since both the flange 84 and the portion 78 are fixed to axle 80, rotation of one results in rotation of the other. When a plurality of adjacent display portions 78 are in their downward positions, such as the display portions 78*a* and 78*e*, a downwardly inclined path is formed for a ball 44 by the upper surfaces 86 of successive flanges 84 between a guide element 87 on each flange and wall portion 39.

Indicating element 24*a*, the first element in the line of elements 24 includes an extension 88 extending from the axle 80 in a direction opposite to the direction of extension of flange 84 and forming a path together with the aligned flanges 84 of downwardly arranged indicating elements 24*e*. The extension 88 rotates from its downward position shown in FIG. 6 to its upward position shown in dotted lines in FIG. 7.

On the opposite side of housing 14 a fixed indicating element 24*b* includes no flange 84 and is fixed to walls 35 and 41. The element 24*b* is spaced above the track 30 to permit a ball 34 to roll beneath the element 24*b* on the track 30.

Adjacent fixed element 24*b*, a rotatable "first" element 24*c* includes an additional laterally extending tab portion 108 extending from the side of flange 84*c* over wall 34*b* and track 30 towards swall 35. The column of indicating elements 24 rotate to the vertical position to change the time indicated. After they have all been righted engagement of tab 108 by a ball 44 rotates display portion 78 of element 24*c* downwardly in the direction as indicated by arrows 102. This action causes element 24*c* to contact the next adjacent element 24*d* causing it to fall to its downward position and so on resetting all ements 24 in the column. This "domino effect" is conveyed from element 24 to element 24 in the line until all elements 24 except the fixed element 24*b* are rotated to their downward position. When element 24*c* is in its downward position (not shown) the end of its flange 84*c* is closely adjacent the fixed element 24*b*.

The downward rotation of a flange 84 results in an upward rotation or righting of its display portion 78 as indicated by the arrow 92, until the backside 93 of the element 24 comes to rest against angled stop 94 extending outwardly from wall 35. In this position protruding edge 90 of the element 24 extends generally upwardly forming a stop in the path created by the remaining downwardly positioned elements 24.

Figure 3:
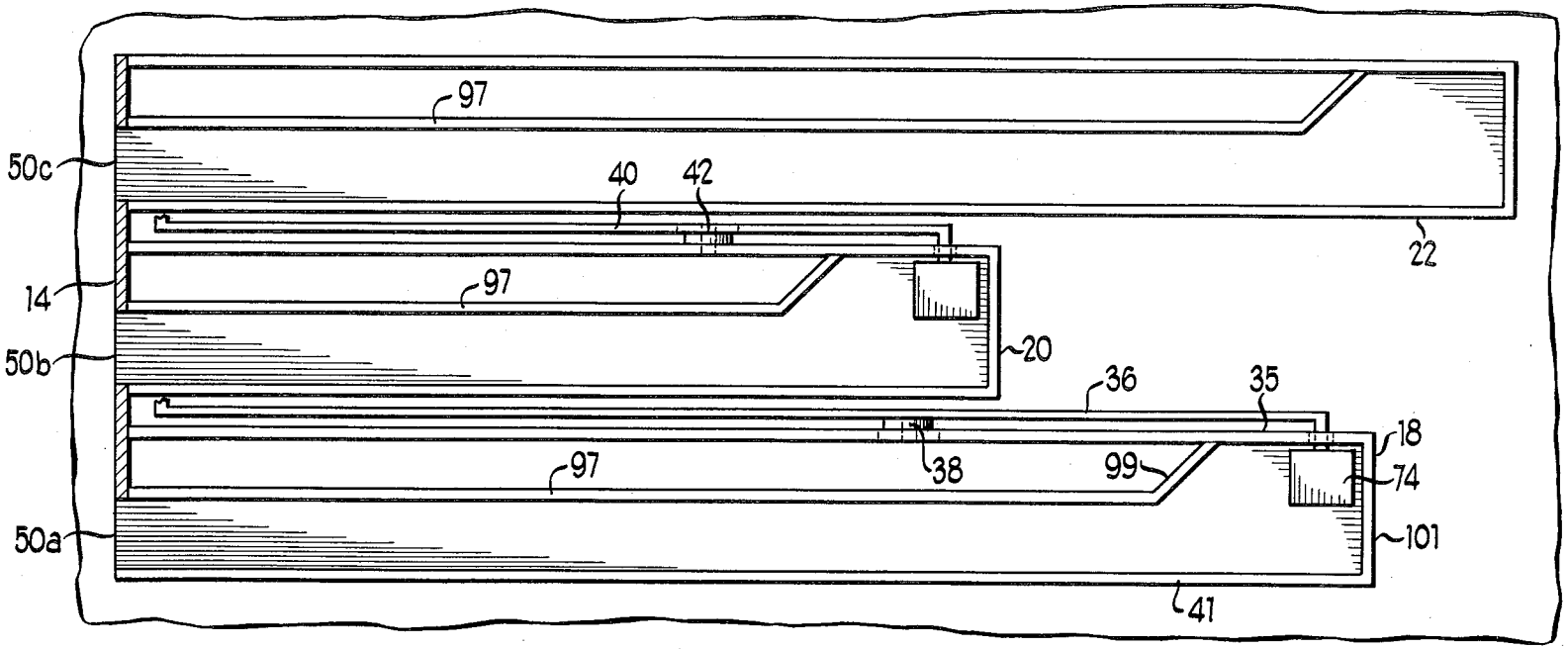
FIG. 3 is a partial, cross-sectional view taken generally along the lines 3—3 in FIG. 1.

Beneath elements 24, an apertured surface 37 includes a plurality of holes 96 arranged in a line and below surface 37, arranged to collect balls 44 passing through holes 96, is an inclined tray 98, inclined in an opposite direction to the surface 37. The inclined tray 98 is sloped toward an exit aperture 50*b* in side 23 aligned with a depression 68 in cross-member 66 of U-shaped elevator 52 in its downward position. Tray 98 includes an upstanding wall 97 along its length spaced and generally parallel to wall 41 to guide a ball 44 to the aperture 50 as shown in FIGS. 3 and 6. An opening 138, located near the highest position of the tray 98, adjacent platform 74 is defined by tray 98, and walls 99, 101, 35 and 41.

Figure 5:
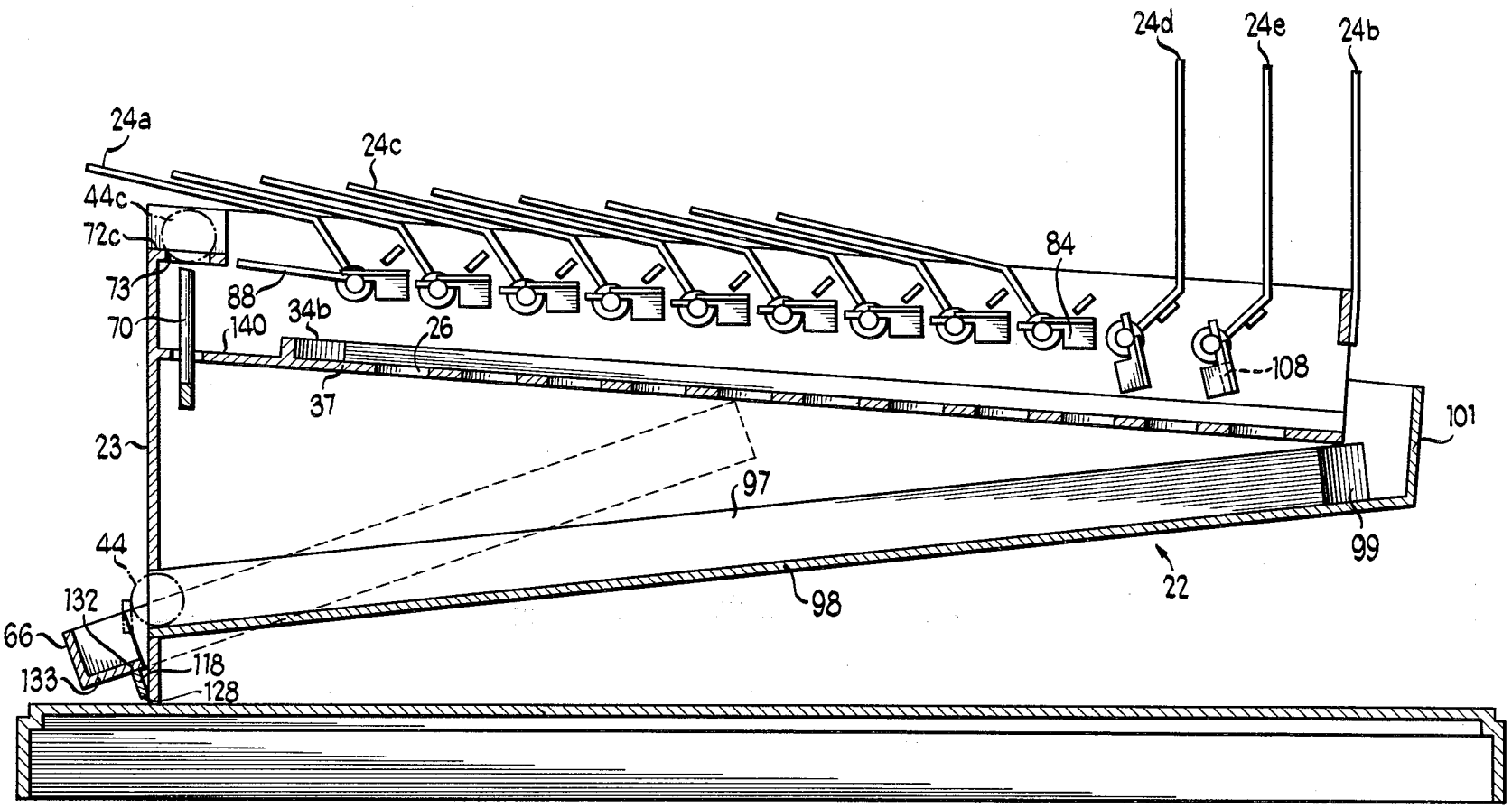
FIG. 5 is an enlarged, cross-sectional view taken generally along the line 5—5 in FIG. 1.

Each unit 18, 20 or 22 includes its own tray 98 communicating with apertures 50*a*, 50*b* and 50*c*, respectively, and indicating elements 24, and is otherwise arranged in the same configuration as the other units as indicated in FIG. 5 with respect to the unit 22, except as explicitly set forth herein. However, each unit does include a different number of indicating units 24. Unit 18, effective to display minutes includes ten elements 24 indicative of from zero to nine minutes. The unit 20, effective to display tens of minutes, includes six elements 24 indicative of from zero to five tens of minutes while unit 22 displays hours using twelve elements 24 indicative of from one to twelve hours. The value of each element 24, represented by dots 26, increases from right to left in FIG. 2. The dots 26 are arranged in the pattern used on dominos.

The U-shaped element 118, located beneath U-shaped elevator 52, rotates around pins 120 on either side of housing 14 located in lateral arms 121 that connect to cross-member 122. The cross-member 122 is biased upwardly by counterbalance weights 124 on the ends of arms 121. When U-shaped elevator 52 is in its downward position resting atop U-shaped portion 118, its weight is sufficient to maintain U-shaped portion 118 in its downward position. As shown in FIG. 5, when the portion 118 is in its downward position one edge 128 resets against wall 23 while the other edge 132 contacts the underside 133 of U-shaped elevator 52.

When U-shaped elevator 52 is rotated to its upward position shown in FIG. 1, counterbalance weights 124 rotate U-shaped portion 118 upwardly to a horizontal position against stops 126 on housing 14 with cross-member 122 obstructing the apertures 50. This prevents the balls 44 from exiting from apertures 50 when the U-shaped elevator 52 is not in position to collect them as indicated in dotted lines in FIG. 5. When the elevator 52 is rotated back to its downward position shown in FIG. 4, it returns the U-shaped portion 118, contacted with its underside 133, to its downward position by pushing downwardly against the force supplied by counterbalance weights 124. Since lateral members 67 of elevator 52 are spaced slightly from housing 14, elevator 52 is unaffected by stops 126.

Atop each unit 18, 20 or 22 adjacent wall 23 is an inclined ball receiving surface 72, aligned with the depressions 68 of elevator 52 as shown in FIG. 2. Surface 72*a*associated with unit 18 inclines downwardly towards elements 24. The surfaces 72*b* and 72*c*, associated with units 20 and 22 respectively, each include an opening 73 sized to trap a ball 44 rolled onto the surface 72 from elevator 52. Lateral guides 75 direct the balls 44 along the surfaces 72, and, in the case of surfaces 72*b* and 72*c*, cause the ball 44 to become trapped in an opening 73. Algined beneath each opening 73, a pin 70 of pivoting member 36 or 40 is arranged to move upwardly through the opening 73 in response to a downward force applied to its associated platform 74.

The extension 88 of each indicating element 24*a* is positioned closely adjacent the lower end of each surface 72 when the element 24*a* is in its downward position. When the element 24*a* is in its upward position no path is formed between the surface 72 and the elements 24 over the surface 140 of the track 28, 30 or 32 below.

The device 10 can be utilized as a clock as follows. The device 10 is connected to a synchronous motor 58 designed to rotate one revolution per minute. Three heavy steel balls 44 are manually loaded into each depression 68 of elevator 52. The motor 58 rotates the disc 50 and the pin 62 extending outwardly of the disc 60 near its periphery, riding in a slot 64 in elevator 52 to oscillate the elevator 52 upwardly and downwardly between the positions shown in FIGS. 1 and 4.

The balls 44 in depression 68 are carried upwardly with the elevator 52 and poured from the depressions 68 over the side 23 atop housing 14. One ball 44*a* contacts inclined top surface 72*a* and begins to roll downwardly from left to right over the extension 88 of the first indicating element 24*a*, continuing downwardly over aligned flanges 84 until the ball reaches the last rotatable element 24*c* in the line. The ball 44*a* is stopped over the last rotatable element 24*c* by the fixed element 24*b*. As a result the flange 84 associated with the element 24*c* is rotated downwardly by the continued presence of the ball atop that flange, sufficient to overcome the inertia of the element 24c, rotating its display portion 78 to its upward position. Each display portion 78 of each element 24 includes a number of dots 26 indicative of its position with the indicating element 24c having the indicia representative of "one" and each successive display element having a successively higher indicia while the fixed display element 24b bears no dots 26 on its surface, indicative of "zero."

After actuating the element 24 the ball 44 falls downwardly, since the flange 84 has been rotated out from beneath the ball 44, through a hole 96 in apertured surface 37 onto inclined tray 98. The ball rolls down inclined tray 98 to aperture 50a. If the elevator 52 is in its downward position the ball 44 rolls into a depression 68a. The elevator 52 carries the ball upwardly when actuated by motor 58 and again pours the ball 44a onto the surface 72a.

The ball 44a again rolls downwardly atop the flanges 84 of the elements 24, this time until it reaches element 24c previously actuated. The ball 44a is stopped by the edge 90 of that element causing the flange 84 associated with the preceding element 24d to rotate downwardly. As a result, the display portion 78d is raised upwardly displaying two dots 26.

In this way each display element 24 of unit 18 is successively rotated to its upward position indicating the passage of time from zero to nine minutes as the ball actuates one element 24 after another and is carried back atop the housing 18 by the elevator 52 every minute. With all nine elements 24 positioned in their upward display position, the ball 44a is again poured onto inclined top surface 72a, but this time it immediately falls downwardly onto surface 140 because extension 88 of element 24a has been rotated out of alignment with the surface 72a. Thus, the ball 44 rolls downwardly following track 28 around elements 24 until the ball contacts the outwardly extending tab 108 of the element 24c, rotating the element 24c to its downward position. Rotation of the element 24c causes it to contact the next element 24d. As a result successive elements 24e and finally element 24a are rotated to their downward position so that all the elements 24 in unit 18 are in their downward position except the fixed element 24b, indicating "zero." Ball 44 continues past the element 24c with its extension 88 now rotated out of the path of the ball 44 until it contacts platform 74. Due to the weight of the ball 44a rolling over it, the platform 74 pivots around pivotal mounting 48 causing the pin 76 connected to the other end of the pivoting member 36 to move upwardly. The ball 44, having rolled over the gently inclined upper surface of the platform 74 falls into an opening 138 communicating with tray 98 returning the ball via aperture 50a to elevator 52.

A ball 44b is located in opening 73 of unit 20 due to the initial upward oscillation of elevator 52, pouring a ball 44a onto inclined surface 72a, a ball 44b onto inclined surface 74b and the ball 44c onto inclined surface 72c. The balls 44b and 44c roll downwardly guided by guide wall 75 becoming trapped in openings 73b and 73c, respectively. The ball 44b is now dislodged from opening 73b by the pin 70 of pivoting member 36. The dislodged ball 44b rolls down extension 88 of indicating element 24a of unit 20. The ball 44 continues rolling downwardly atop flanges 84 of successive elements 24 guided by the guide elements 87 on each flange 84 until the rotatable element 24c, in its downward position, is reached. At this time the ball is trapped between the element 84c and the fixed element 24b. The sustained presence of the ball in this position causes the flange 84c to rotate downwardly and the display portion 78c of the element 24c to rotate upwardly. Display portion 78c contains one dot indicative of ten minutes. In this way the tens place is carried from the unit 18 to the unit 20 and represented by the unit 20. Subsequently, the ball 44a operates upon unit 18 to indicate ten through nineteen minutes as described previously. After nineteen minutes, the ball 44b is again dislodged from the opening 70, as described before, resulting in the display of an element 24d in unit 20, indicative of 20 minutes.

This process continues until the device 10 displays 59 minutes. After one more minute all the rotatable elements 24 associated with units 18 and 20 are rotated to their downward positions so that only the fixed zero indicating elements 24b are visible on units 18 and 20 and the unit 22 is actuated to indicate one hour or one o'clock. Transfer between the ten minute 20 and the hour unit 22 is identical to that described with respect to the transfer between the minute unit 18 and the ten minute unit 20. A ball 44b rolling over platform 74b causes the rotation of pivoting member 40 resulting in a ball 44c positioned in opening 73c being dislodged by a pin 70. The ball 44 precedes downwardly above apertured surface 37 of unit 20 until the rotatable element 24c is operated, indicating one hour.

The elevator 52 returns to its downward position at one minute intervals to receive a ball 44 in a depression 68. The ten minute and hour depressions 68b and 68c are therefore usually empty while the minute depression 68a is filled for each upward oscillation. When the elevator 52 rotates to its upward position the ball 44 just received is poured onto the aligned surface 72 at the top of the device 10. Since no balls are retained on the top surface 72a of the minutes unit 18 the ball 44a immediately begins to roll downwardly to actuate an element 24 in unit 18. If a ball 44 has just operated a unit 20 or 22 it is returned by the elevator 52 to an opening 73.

Each time the elevator 52 rotates upwardly the apertures 50 are closed by U-shaped portion 118. This is because the portion 118 is counterbalanced by weights 124 so that portion 118 is rotated to a horizontal configuration against stops 126, as shown in FIG. 1, when the elevator 52 no longer retains it in its downward position. When elevator 52 returns, its weight replaces the portion 118 in its downward position.

To utilize the device 10 as a clock, the present time is set by manually rotating the display portions 78 of each unit to indicate the correct time and the device thereafter continuously increments the elements 24 to continuously display the correct time. The device 10 provides a novel display of time since the display portion 78 may contain domino indicia and upon transfer of value from one unit to the next, the upwardly positioned elements 24 are automatically rotated to their downward position by rotation of adjacent elements against each other in a domino effect. In this way the device 10 is capable not only of displaying the time but of providing a novel conversation piece as well.

It will be obvious that the device 10 can be used to count any desired phenomenon by substituting for motor 58 an appropriate mechanism to either operate the elevator 52 to supply balls to the surface 72 atop the device 10 or to itself supply balls to the surface 72.

The foregoing detailed description has been given for clearness of understanding only. Therefore no unnecessary limitations should be understood therefrom and many modifications will be obvious to those skilled in the art.

What is claimed is:

1. A counting device comprising:

a ball;

a housing including an inclined track for said ball;

a plurality of indicating elements aligned with said track mounted for rotation against the next adjacent element in said line;

actuating means operatively connected to said indicating elements for rotating said elements when said actuating means is contacted by said ball as it rolls along said track; and means for returning said ball to the upper end of said track.

2. The counting device of claim 1 including at least two tracks, each track including a plurality of indicating elements aligned with each of said tracks, arranged side by side in a line, and mounted for rotation against the next adjacent element in said line, one of said tracks including means for rotating one of said elements into the next adjacent element after all of said elements along said track have been actuated, and further including means for actuating an element along one of said tracks when all of the elements on the other of said tracks have been actuated.

3. The counting device of claim 2 including a motor operatively connected to said raising means to repetitively raise a ball from the low end to the high end of said tracks at timed intervals.

4. The counting device of claim 3 including three tracks and associated indicating elements, the elements of one of said tracks indicative of minutes, the elements of another track indicative of ten minutes, and the elements of the other track indicative of hours, arranged to indicate the time of day.

5. The device of claim 4 including inclined means for returning said ball to a position to be raised by said raising means.

6. The device of claim 5 including means for retaining said balls within said device until said raising means is returned from the high end to the low end of said tracks.

7. The device of claim 6 including means on said ten minute and hour tracks for retaining said balls at the high end of said track.

8. The device of claim 7 wherein said means for actuating an element in one track when all the elements on the other track have been actuated including a pivotal lever having one arm in communication with one track and the other arm in communication with the other track.

9. The device of claim 8 including means on one of said arms for dislodging said balls retained in another of said tracks.

10. The device of claim 1 including at least two tracks, each track including a plurality of rotatable indicating elements arranged in a line and mounted for rotation around generally parallel axes, said indicating elements each including a rotatable flange connected for rotation with said indicating element but extending at an angle from said indicating element, said flanges of said indicating elements forming said track from one element to the next when said elements are in one position.

11. The device of claim 10 including a collection means beneath said tracks for returning said balls to said raising means.

12. The device of claim 10 including on one of said tracks means for retaining said ball in its raised position.

13. The device of claim 12 including an alternative path for said ball, and means for switching said ball from said track to said alternative path.

14. The device of claim 13 including a pivoting member having a pair of spaced ends and an intermediate pivot point, one of said ends positioned in said alternative path of one track and the other of said ends positioned in said other track, arranged to dislodge said ball from said retaining means.

15. The device of claim 14, wherein one of said indicating elements includes an extending member extending over said alternative path to rotate said member from an upstanding position to a downward position contacting the next adjacent element.

16. The device of claim 13 wherein said switch means includes an outwardly extending tab fixed to the first indicating element in the path of said ball on the upper end of said track.

17. The device of claim 10 wherein said elements are rotatable from an upstanding display position to a downwardly directed non-display position, said flanges forming said tracks when said elements are in said downwardly directed position, said elements including stop members interposed along said track when one of said elements is in its upward position, said stop members arranged to stop said ball over the flange of an adjacent element in a non-display position to cause said ball to rotate said flange of said element from its downwardly to its upwardly directed position.

18. A time counting device comprising:

a ball;

a housing;

a plurality of indicating elements arranged in two columns, said elements of each of said columns mounted on said housing so as to be rotatable around generally parallel axes, all of said elements in each column but one arranged to rotate against an adjacent element in said column;

a ball actuated display means for periodically successively rotating said elements in a first column from a non-display position to a display position:

a ball actuated non-display means for causing the elements of a first column to be rotated to a non-display position one after another after all of said elements in said first column have been rotated to the display position; and a ball actuated carrying means for rotating one of said elements of a second column from said non-display to said display position when all of said elements of said second column have been rotated to the display position.

19. The device of claim 18 including one ball for each of said columns.

20. The device of claim 18 wherein said indicating elements bear dots indicative of their value.

21. The device of claim 18 including an inclined track for moving a ball past each of said columns.

22. The device of claim 21 including means for raising said balls from the low end of said track to the high end of said track at timed intervals.

23. The device of claim 22 including means for retaining said ball at the low end of said track when said raising means is raised from said low end.

24. The device of claim 23, said retaining means being a counterbalance member rotatable to retain said ball when said raising means is raised.

25. The device of claim 18 wherein said display means includes a flange rotatable with said indicating element, forming a ball conveying path with successive elements from each column when in a non-display position.

26. The device of claim 25 wherein said display means includes a tab positionable in said path when said element is rotated to its display position, arranged to stop said ball atop an adjacent element in its non-display position to cause said element to be rotated to its display position.

27. The device of claim 18 wherein said non-display means include means for switching said ball to a second path to avoid said display means when all of said elements are in said display position, said non-display means including a member extending into said second path actuable by said ball to rotate one of said elements from its display to its non-display position contacting an adjacent element in route and rotating that element from its display to its non-display position.

28. The device of claim 27 wherein said carrying means includes a pivotable member having an intermediate pivot point and a pair of spaced ends, one of said ends positioned at the end of said second path and the other of said ends positioned to dislodge a second ball to actuate an element in said second column.

29. The device of claim 27 including two balls and an inclined surface means for returning said balls into a position to be collected by said raising means.

30. The device of claim 18 including three columns of indicating elements, one column indicative of from zero to nine minutes, the other column indicative of from zero to five tens of minutes, and the last column indicative of from one to twelve hours.

* * * * *